United States Patent [19]

Brown

[11] 4,034,897

[45] July 12, 1977

[54] HIGH DENSITY LIQUID DISPENSER

[75] Inventor: Merle S. Brown, Cohasset, Mass.

[73] Assignee: Jet Spray Cooler, Inc., Waltham, Mass.

[21] Appl. No.: 657,945

[22] Filed: Feb. 13, 1976

[51] Int. Cl.[2] ..... B67D 5/62

[52] U.S. Cl. ..... 222/146 C; 141/298; 222/509

[58] Field of Search ..... 141/147, 301, 295, 298; 222/146 C, 509, 510, 146 HE, 481, 481.5

[56] References Cited

U.S. PATENT DOCUMENTS

| | | | |
|---|---|---|---|
| 545,284 | 8/1895 | Green | 222/509 X |
| 985,312 | 2/1911 | Woods | 141/298 |
| 2,607,519 | 8/1952 | Sandborn | 222/146 C X |
| 2,879,810 | 3/1959 | Craig | 222/509 X |
| 2,901,009 | 8/1959 | Potter | 141/301 |
| 2,954,806 | 10/1960 | Kerr | 141/295 X |
| 3,269,606 | 8/1966 | Armstrong | 222/146 C |

*Primary Examiner*—Stanley H. Tollberg
*Assistant Examiner*—Hadd Lane
*Attorney, Agent, or Firm*—Wolf, Greenfield & Sacks

[57] ABSTRACT

A dispenser for high density liquids such as barium sulphate comprising a housing with a bowl seated on the housing and containing the liquid. Refrigeration coils in the bowl chill the liquid, and a variable speed paddle type pump also in the bowl mixes and circulates the liquid about the refrigeration coils and maintains the mixture in suspension. A dispensing valve assembly includes a body having a passage which extends axially through it and a vent tube that extends upwardly from the body. The vent tube and body prevent build up of the liquid about the valve which otherwise would dry and cause valve blockage.

9 Claims, 6 Drawing Figures

HIGH DENSITY LIQUID DISPENSER

INTRODUCTION AND BACKGROUND

This invention relates to liquid dispensers and more particularly comprises a dispenser particularly suitable for mixing and dispensing high density liquids such as barium sulphate and liquids in suspension. A particular application of this dispenser is in X-ray laboratories where barium sulphate is dispensed to patients before undergoing examination. In the following description, the dispenser is described in terms of its use as a barium sulphate dispenser but it will be appreciated that the invention has wider application.

At the present time, barium sulphate is regularly mixed and dispensed from a container by mixing the prescribed amount of barium sulphate with water (usually tap water) and then pouring the mix into a cup for the patient to drink. Because the mixture is warm or at best only slightly cool, the patient is reluctant to drink it because of the taste. Moreover, the mix is not always consistent.

Heretofore, automatic dispensers have been considered unsuitable for this use because of the difficult problems involved in handling the barium sulphate. For example, the barium sulphate is not soluable in water and tends to settle to the bottom of the liquid. Consequently, the liquid must be shaken constantly to avoid the settling action or kept in suspension by a constant paddling. A more acute problem in handling barium sulphate arises from the tendency of the liquid to dry and block the discharge opening of its container. If a valve controls flow through the discharge, the valve must be heavy enough or have biasing means which are sufficiently forceful to cause the valve to close. In addition, the valve must be so constructed that the liquid does not collect in the discharge passge, exposed to the atmosphere, and be permitted to dry there which would very quickly clog the valve.

One important object of this invention is to provide a dispensing valve which will not clog when called upon to dispense such high density liquids as barium sulphate.

Another important object of this invention is to provide a liquid dispenser having a circulator capable of handling heavy liquids that have a density two or more times that of water without a great amount of settling of theinsoluable particles in the mix.

Yet another important object of this invention is to provide a liquid dispenser having cooperating circulation and refrigeration systems capable of maintaining the temperature of heavy liquids in the range of 35° F.

To accomplish these and other objects, the dispenser of this invention includes a bowl having a variable speed paddle-type mixer-circulator and an evaporator coil which together mix and circulate and refrigerate the liquid. The mixer-circulator and evaporator are free of restricted passages so as not to impede the flow of liquid having a specific gravity of two or more. The dispenser also includes a specially designed valve which is vented so as not to allow any liquid to accumulate in the valve after it is closed. As a result, no liquid is trapped in the valve beyond the influence of the circulating system in the bowl.

These and other objects and features of this invention will be better understood and appreciated from the following detailed description of one embodiment thereof, selected for purposes of illustration and shown in the accompanying drawing.

BRIEF FIGURE DESCRIPTION

FIG. 1 is a side view of a dispenser constructed in accordance with this invention.

DETAILED DESCRIPTION

Figure 4:
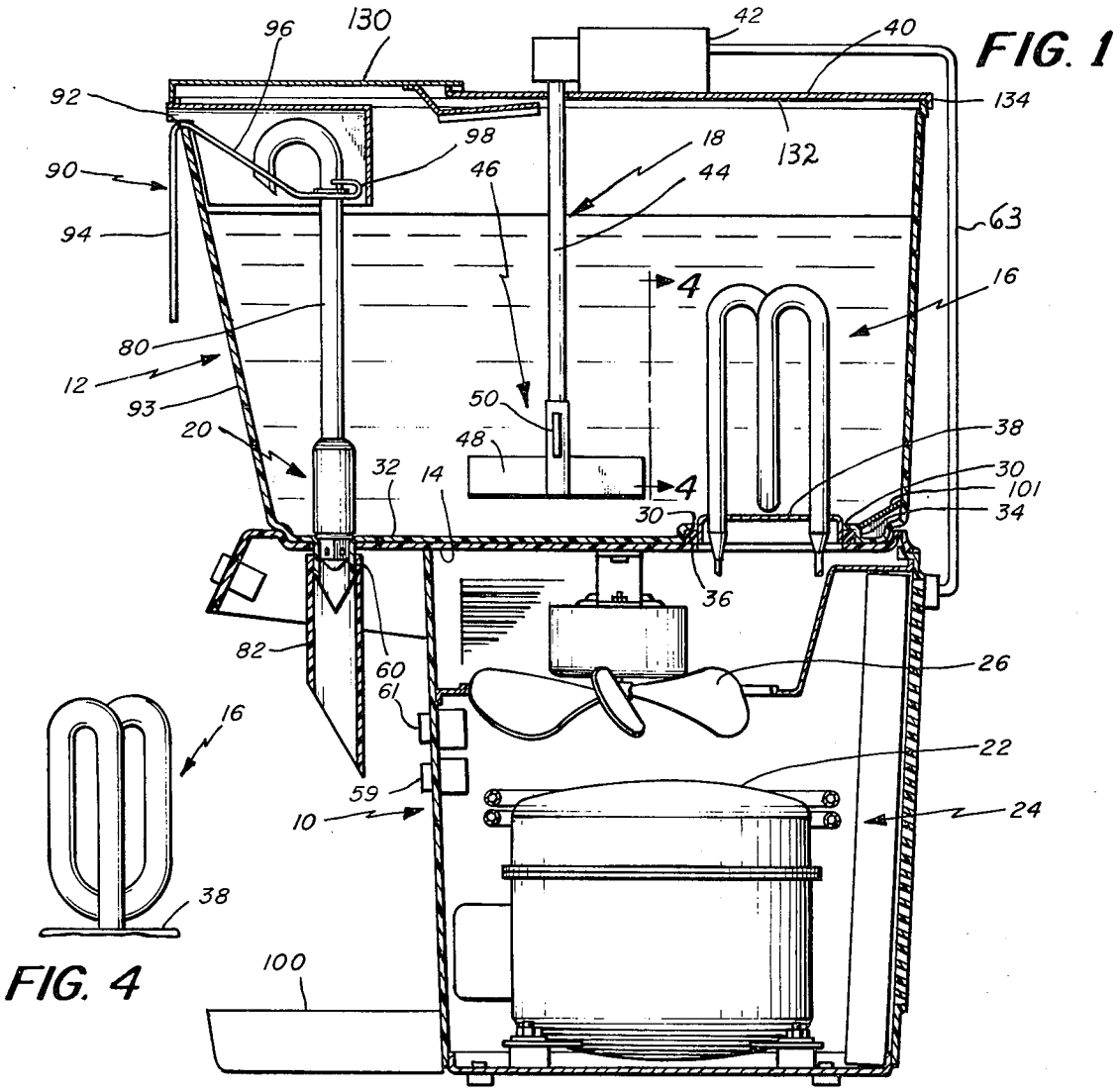
FIG. 4 is an elevation view of the refrigeration coils looking in the direction of sight line 4—4 of FIG. 1.
Figure 2:
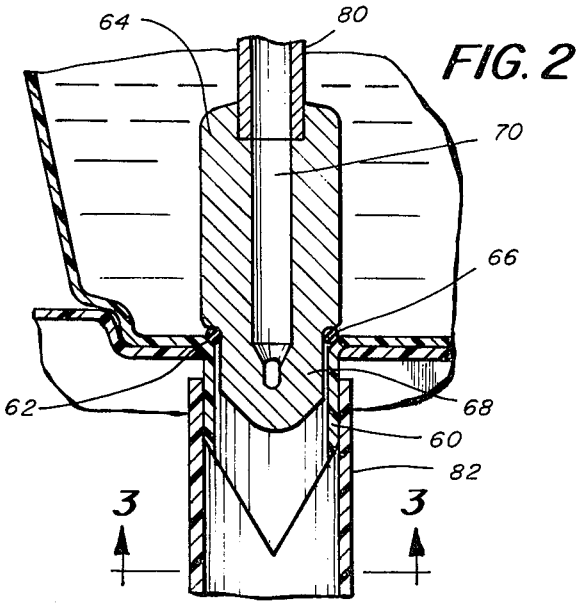
FIG. 2 is an enlarged fragmentary view of the bowl and dispensing valve assembly of the machine shown in FIG. 1.

The dispenser shown in FIG. 1 includes a base 10 and liquid bowl 12 which rests on the top wall 14 of the base. In the dispenser illustrated, bowl 12 is made of a transparent material such as plastic. The bowl contains refrigeration coils 16, circulator 18 and dispensing valve assembly 20.

Base 10 houses a compressor 22, condensor coils 24 and motor driven fan 26 that comprises part of the refrigeration system. It is to be understood that the refrigeration coils 16 that comprise the evaporator of the refrigeration system are connected to the compressor and condensor as a complete refrigeration assembly. The coils are in the form of one inverted U and one upright U lying in mutually perpendicular planes, as viewed in FIGS. 1 and 4.

Bowl 12 includes an opening 30 in its bottom wall 32 surrounded by upstanding flange 34 which engages gasket 36. The gasket 36 engages the plate 38 through which the coils extend to seal the opening. Nevertheless, the bowl may be lifted from the base when empty so that it may be washed.

Bowl 12 has a removable cover 40 on which is mounted mixer-circulator motor 42. Motor 42 carries an elongated shaft 44 that extends downwardly in the bowl when the cover is in place, to a point adjacent bottom wall 32 of the bowl. The end of the shaft carries the paddle 46 composed of two blades 48 and 50 disposed at right angles to one another. In the embodiment shown, blade 50 is disposed immediately above blade 48. The blades disposed at the bottom of the bowl are designed to mix the product initially with water and to agitate the liquid so as to prevent settling of any additives in it and further causes the liquid to circulate about the refrigeration coils 16 so as to expose the liquid directly to the surface of the coils for cooling. The blades may take several different shapes, and the embodiment shown is merely exemplary of the different arrangements that may be used. It is, however, important that the circulation system be free of small passages or other flow obstructions which would place an increased load on motor 42. Because the liquid is of high density, i.e. perhaps 125 pounds per cubic foot, the liquid itself places a very heavy load on the motor. Therefore, it is important that the space about the refrigeration coils 16 be free of restrictions so that the liquid may flow quite freely about the coils. For this reason, the evaporator does not include a shroud or other type of gating which would confine flow of the circulating liquid to a prescribed course about the coils. A baffle plate 51 is also provided in the rear of the bowl about the base of the coils 16 to stream line the flow path for the liquid.

Preferably motor 42 is a variable speed d.c. motor capable of driving the blades at 100 to 300 r.p.m. When the bowl is initially filled, the motor is run at the higher speed for approximately 30 minutes to an hour to achieve proper mixing. Thereafter, the motor may be run at the lower speed to continue circulation about the refrigeration coils and maintain the liquid in suspension. Speed control knob 59 on the base adjacent the on-off switch 61 is provided for the motor speed control. Motor 42 is connected to the control knob through cord 63 plugged into the back of the base.

Bowl 12 has a discharge spout 60 in the form of a cylindrical tube disposed at the front of the bowl forward of the base 10. The top of the spout is provided with a valve seat 62 on which the valve body 64 rests when the spout is closed. The body 64 carries an O-ring shaped seal 66 at the top of the lower section 68, and the seal engages the seat to seal the spout closed when the body is in the lower position.

Figure 3:
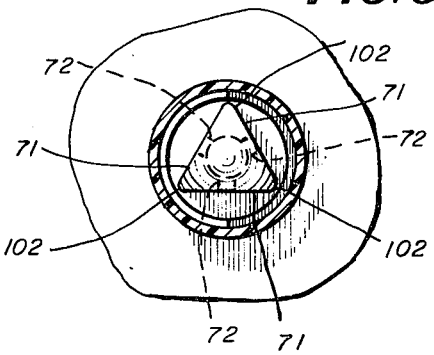
FIG. 3 is a bottom view of the valve looking in the direction of sight line 3—3 of FIG. 2.

An axial passage 70 extends from the top of valve body 64 to a position below the seal 66. The lower end of passage 70 is connected to three radial passages 72 which extend from the bottom of passage 70 to the three vertical surfaces 71 of the lower body section 68, as is illustrated in FIG. 3.

A vent tube 80 is seated in the top of passage 70, which extends upwardly from the body 64 to a point above the highest normal level of liquid in bowl 12. The upper end of tube 80 is bent over so as to prevent the agitated fluid from accidentally entering the tube. In the preferred form, the assembly also includes a tube extension 82 carried on the spout 60 which aids in preventing the liquid from drying in the spout as is described more fully below.

A push handle 90 is pivotally supported on the top edge 92 of the front wall 93 of bowl 12. The handle includes a lever 94 externally of the bowl and an arm 96 bent to engage the vent tube 80 as shown at 98. The turned down upper end of tube 80 also engages a hole 95 in the arm 96 of the handle to prevent the tube from rotating. A handle cover 110 which prevents build up of barium on the handle has side walls 112, rear wall 114 and a pitched roof 118 and extends over the handle 90 and the top end of vent tube 80. A pair of clips 120 are secured to handle cover 110 and engage the upper end of front wall 93 to hold the cover in place.

It is evident that when the lever 94 is pushed toward the front wall of bowl 12, the arm 96 swings upwardly and carries vent tube 80 and valve body 64 with it. This action unseats seal 66 from valve seat 62 so as to open the discharge spout 60 and allow the contents of the bowl to flow out. The liquid passes by the flat sides 71 of the lower body portion 68 and through spout 60 and tube 82 to the cup or other container placed on the drip tray 100 connected to the bottom of base 10. To close the valve the push handle lever 94 is released, and the body automatically seats itself with the O-ring engaging valve seat 62. The corners 102 of the lower body portion 68 act as guides in the spout 60 to maintain the valve body 64 in proper alignment with the spout as the body is moved up and down. The vent tube 80, axial passage 70, and radial passages 72 prevent a vacuum from forming in tube 60 below body 64 so that the liquid does not "hang" in the tube 60, dry, and consequently clog the system.

Figure 5:
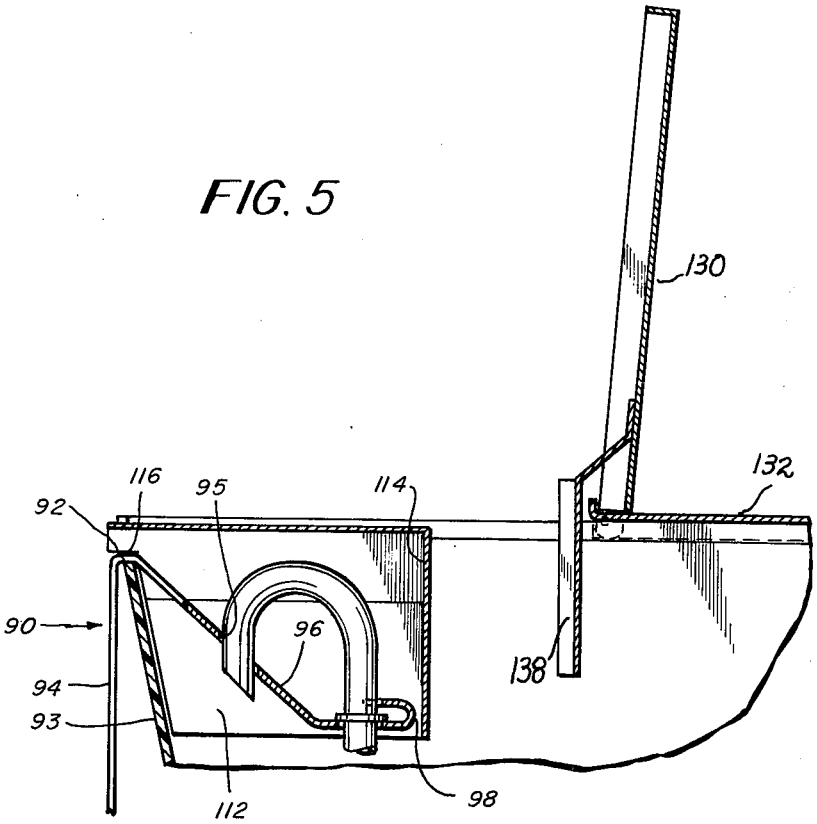
FIGS. 5 and 6 are fragmentary cross sectional and front views of the bowl and cover.
Figure 6:
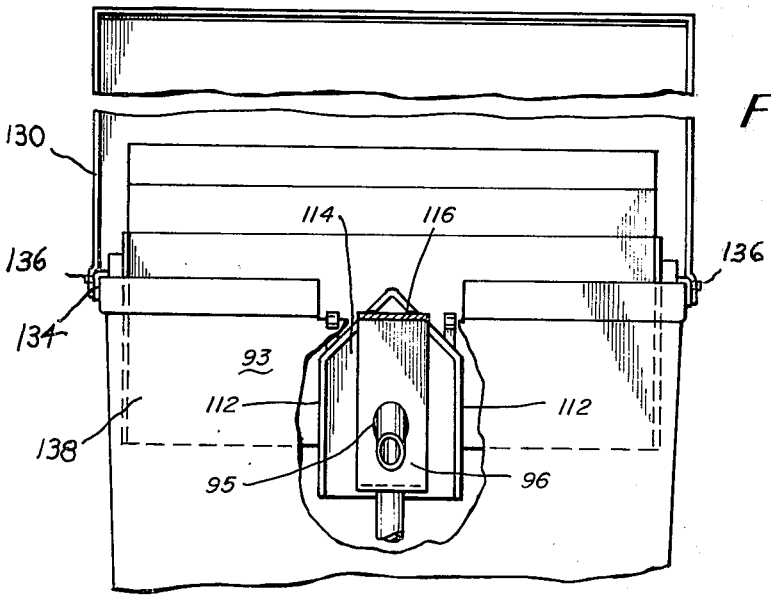

Cover 40 as shown in the drawing is essentially composed of a front section 130 and rear section 132. The rear section which sits on the rim of the bowl has a skirt 134 that extends down outside the bowl about three sides, and rear section 132 can be lifted off the bowl for cleaning or any other purpose. Front section 130 is pivotally supported on pins 136 extending outwardly from the skirt of the rear section and carries a plate 138 that prevents any barium on the front section from dripping onto the top of rear section 132 when the front section is lifted to the raised position of FIG. 5.

It is evident from the foregoing description that a dispenser of the type shown may be placed at some convenient location in an X-ray laboratory, and a patient may dispense his own requirements merely be placing a cup on the drip tray 100 and pushing handle 94. When the handle is released, the dispensing action will cease. The barium sulphate will be maintained at a chilled temperature by virtue of the constant circulation of the liquid about refrigeration coils 16. And the constant agitation of the liquid will prevent any barium sulphate from settling in the bowl. And the valve assembly may be lifted out of the bowl for cleaning when the bowl is empty.

From the foregoing description, those skilled in the art will appreciate that numerous modifications may be made of this invention without departing from its spirit. Therefore, we do not intend to limit the breadth of the invention to the single embodiment illustrated and described. Rather, the scope of this invention is to be determined by the appended claims and their equivalents.

What is claimed is:

1. A dispenser for heavy, quick drying liquids such as barium sulphate comprising a housing, a bowl seated on the housing and adapted to contain the liquid to be dispensed by the dispenser, refrigerating means disposed in the bowl for chilling the liquid in it, a circulator mounted in the bowl for moving the liquid about the refrigeration means and for maintaining the liquid in suspension, a tube defining a discharge spout in the bowl for withdrawing the liquid, a valve seat at the discharge spout, a valve body in the bowl and having a portion adapted to rest on the seat to close the spout, said valve body lying within the bowl and biased to rest on the valve seat, said body having a lower portion spaced from the tube when the valve body is seated, a vent tube connected to the body and extending above the highest normal liquid level in the bowl, a passage through the body communicating with the tube at the passage top and open at the bottom in the spout below the seat, said passage in the body extending to the lower portion of the body and terminating on the body surface spaced from the tube, an actuator operatively connected to the body and extending out of the bowl for raising the body off the seat.

2. A dispenser as described in claim 1 further characterized by said circulator comprising a paddle disposed in the bowl adjacent its bottom, and a motor mounted on the bowl and having a shaft which is mechanically connected to the paddle.

3. A dispenser as described in claim 2 further characterized by said motor being a variable speed d.c. motor, and a control for the motor to run it at higher speeds when the bowl is initially filled and at lower speeds to maintain the liquid in suspension and circulate the liquid about the refrigeration coils.

4. A dispenser as described in claim 1 further characterized by said actuator including a handle operatively connected to the valve body through the top of the bowl.

5. A dispenser as described in claim 4 further characterized by said circulator comprising a paddle disposed in the bowl adjacent its bottom, a cover for the bowl, and a motor mounted on the cover and having a shaft which is mechanically connected to the paddle.

6. A dispensing valve assembly for withdrawing liquid comprising a container having a front wall, a discharge spout oriented generally vertically and connected to the container, a valve seat at the spout, a valve body mounted above the spout and carrying a seal for seating on the seat to seal said spout, said body having a lower portion below the seal which extends into and is spaced from the wall of the spout, a passage through the body extending from the top thereof downwardly to the surface of the lower portion at a point below the seal, and a vent tube connected to the top of the body and communicating with the top of the passage, an actuator connected to the vent tube for raising the body off said seat to open the spout, and a handle forming part of the actuator and disposed out of the container and extending into the container over the top of the front wall thereof, said handle being pivotally supported on the top of the front wall.

7. A dispensing valve assembly as defined in claim 6 further characterized by a cover for the container having front and rear sections, said front section being movable independently of the rear section and overlying the valve body and vent tube.

8. A dispenser for heavy, quick drying liquids such as barium sulphate comprising a housing, a bowl seated on the housing and adapted to contain the liquid to be dispensed by the dispenser, refrigerating means disposed in the bowl for chilling the liquid in it, a circulator mounted in the bowl for moving the liquid about the refrigeration means and for maintaining the liquid in suspension, a tube defining a discharge spout in the bowl for withdrawing the liquid, a valve seat at the discharge spout, a valve body in the bowl and having a portion adapted to rest on the seat close the spout, a vent tube connected to the body and extending above the highest normal liquid level in the bowl, a passage through the body communicating with the tube at the passage top and open at the bottom in the spout below the seat, and actuator operatively connected to the body and extending out of the bowl for raising the body off the seat, said bowl having a cover, a motor mounted on the cover for driving the circulator, and means for varying the speed of the motor.

9. A dispensing valve assembly as described in claim 8 further characterized by said cover having front and rear sections, said front section being movable independently of the rear section and overlying the valve body and vent tube, and said motor being mounted on the rear section of the cover.

* * * * *